US005985219A

United States Patent [19]

Lind

[11] Patent Number: 5,985,219

[45] Date of Patent: Nov. 16, 1999

[54] TEST TUBE HOLDER INSERT

[75] Inventor: Torsten Lind, Vallentuna, Sweden

[73] Assignee: Pharmacia & Upjohn Diagnostics AB, Stockholm, Sweden

[21] Appl. No.: 08/894,610

[22] PCT Filed: Feb. 16, 1996

[86] PCT No.: PCT/SE96/00207

§ 371 Date: Dec. 5, 1997

§ 102(e) Date: Dec. 5, 1997

[87] PCT Pub. No.: WO96/27442

PCT Pub. Date: Sep. 12, 1996

[30] Foreign Application Priority Data

Mar. 3, 1995 [SE] Sweden ..... 9500777

[51] Int. Cl.[6] ..... B01L 9/06

[52] U.S. Cl. ..... 422/104; 422/99; 422/102

[58] Field of Search ..... 422/99, 65, 102, 422/104

[56] References Cited

U.S. PATENT DOCUMENTS

| | | | |
|---|---|---|---|
| 4,944,924 | 7/1990 | Mawhirt et al. | 422/104 |
| 5,137,693 | 8/1992 | Mawhirt | 422/104 |
| 5,306,469 | 4/1994 | Iles | 422/104 |
| 5,372,786 | 12/1994 | Iles | 422/104 |
| 5,407,640 | 4/1995 | Iles | 422/104 |
| 5,651,941 | 7/1997 | Stark et al. | 422/104 |
| 5,695,942 | 12/1997 | Farmilo et al. | 422/104 X |

FOREIGN PATENT DOCUMENTS

| | | |
|---|---|---|
| 0414644 | 2/1991 | European Pat. Off. . |
| WO9400238 | 1/1994 | WIPO . |

*Primary Examiner*—Lyle A. Alexander
*Attorney, Agent, or Firm*—Dinsmore & Shohl LLP

[57] ABSTRACT

A unitary test tube holder insert adapted for receiving test tubes. The insert has a first ring to be secured in a hole of a test tube rack. A plurality of spring members extend at one end from the first ring towards a center axis of the ring to resiliently engage the outside of a test tube inserted into the insert. The spring members are connected at their other end to a second ring which is arranged coaxially with the first ring along the center access, and each spring member is curved towards the center axis to exhibit a straight section which extends parallel to the center axis and which resiliently engages the outside of a test tube inserted into the insert.

5 Claims, 1 Drawing Sheet

TEST TUBE HOLDER INSERT

TECHNICAL FIELD

The present invention relates to a test tube holder insert to be inserted into a hole in a test tube rack for receiving test tubes of different diameters, comprising a ring to be secured in said hole and being provided with spring members extending from the ring towards the centre axis of the ring to resiliently engage the outside of a test tube inserted into the insert.

BACKGROUND OF THE INVENTION

Such test tube holder inserts are known. A cross-sectional view of such a known test tube holder insert is shown in FIG. 1 on the appended drawing. The insert shown comprises a ring 1 which in a manner not shown in any greater detail, is designed to be snapped in place in any of the holes in a tray provided with holes for receiving test tubes and belonging to a not shown test tube rack. In the embodiment shown, the ring 1 is provided with spring members in the form of resilient tongues 2, which extend obliquely towards the centre axis of the ring 1.

It has, however, been found that an insert designed in this manner, does not ensure that the test tubes in fact stand vertically in the test tube rack. This is particularly important in order to avoid spillage in connection with e.g. automatic pipetting of radioactive or other toxic liquids in certain applications.

Test tube racks having two trays provided with holes and arranged above each other with the holes aligned for receiving test tubes, are also known. In such test tube racks, inserts of the kind shown in FIG. 1, are secured in the holes in both trays. Hereby, a more stable but not completely reliable fixation is obtained of the lower portion of the test tubes since, after all, the test tubes can end askew.

BRIEF DESCRIPTION OF THE INVENTION

The object of the invention is to bring about a test holder insert for test tube racks, which insert, for test tubes within a certain range of diameters, ensures the vertical alignment of the test tube in test tube racks having one as well as two trays provided with holes.

This is attained by means of the test tube holder insert according to the present invention in that the spring members are connected at their other end to a second ring which is arranged coaxially with the first-mentioned ring along its centre axis, and that each spring member is curved towards said centre axis to exhibit a section which extends parallel to the centre axis and which resiliently engages the outside of a test tube inserted into the insert.

Figure 2:
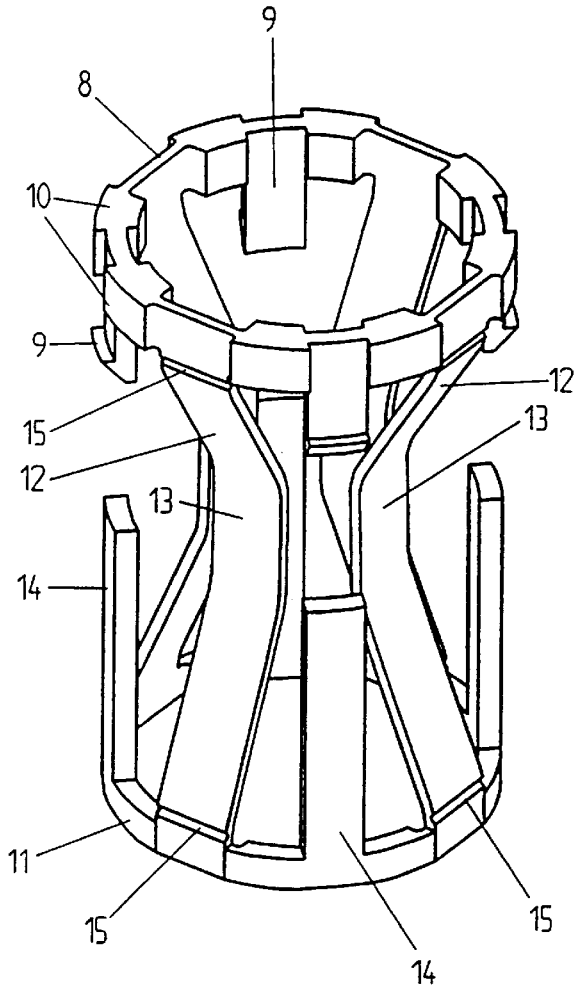
Figure 3:
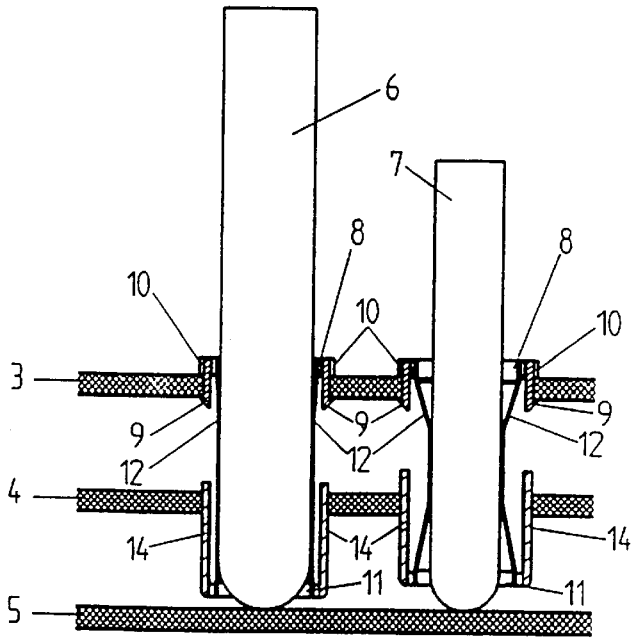

The invention will be described more in detail below with reference to the other Figures on the appended drawing, on which;

FIG. 2 is a perspective view of an embodiment of a test tube holder insert in accordance with the invention, and FIG. 3 is a schematical sectional view of a test tube rack with two test tube holder inserts according to the invention into which two test tubes of different diameters have been inserted.

DESCRIPTION OF PREFERRED EMBODIMENTS

FIG. 2 is a perspective view of an embodiment of a test tube holder insert according to the invention.

The test tube holder insert shown in FIG. 2, is intended to be secured in a hole in a test tube rack in order to make it possible to receive test tubes of different diameters therein.

FIG. 3 is a schematical sectional view of an embodiment of a test tube rack, known per se, with two trays 3 and 4 provided with holes for inserts according to FIG. 2, and arranged above each other. The test tube rack shown also comprises an underlying tray 5 which is adapted to support, from below, test tubes placed in the test tube rack. Two test tubes, denoted 6 and 7, respectively, of different diameters have been inserted into the inserts as shown in FIG. 3.

Figure 1:
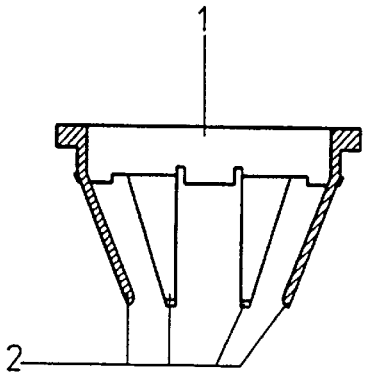
FIG. 1 depicts a test tube insert.

The test tube holder insert according to the invention, shown in FIG. 2, comprises a ring 8 as the known insert shown in FIG. 1. On its outside, that ring is provided, on the one hand, with a number of hook-shaped elements 9 and, on the other hand, with a number of protrusions 10, which are adapted to co-operate in order to secure the insert according to FIG. 2 in the test tube rack according to FIG. 3 in such a manner that the underside of the protrusions 10 will engage the upside of the tray 3, while the hook-shaped elements 9 will snap in against the underside of the tray 3 as clearly apparent from FIG. 3. The hook-shaped elements 9 are designed resilient so that they spring away when they are brought through the hole in the tray 3 to thereafter snap in against the underside of the tray 3.

Of course, the ring 8 can be uniform around all of its circumference but the design shown in FIG. 2 with the radially projecting protrusions 10, is preferable from a manufacturing point of view.

The test tube holder insert according to the invention also comprises a ring 11 which is arranged coaxially with the ring 8 along its centre axis.

According to the invention, a number of spring members 12 extend between the rings 8 and 11. The number of spring members 12 is four in the embodiment of the test tube holder insert according to the invention, shown in FIG. 2. Of course, the number of spring members 12 can be greater than four but has to be at least two in order for the insert according to the invention to function in a desired manner.

According to the invention, the spring members 12 are curved towards the centre axis of the rings 8 and 11 to individually exhibit a section 13 which extends along the centre axis at a predetermined distance therefrom. The surfaces of the sections 13 of the spring members 12, facing the centre axis, are intended to resiliently engage the outside of a test tube inserted into the insert such as the test tubes 6 and 7 shown in FIG. 3.

The length of the sections 13 is e.g. around 5 mm for inserts having a length of around 32 mm.

In the embodiment shown in FIG. 3, the sections 13 of the spring members 12 are concealed by the respective test tube 6 and 7.

On a comparison of the two inserts with the test tubes 6 and 7, respectively, of different diameters, the insert is prolonged downwards the greater the diameter of the test tube is, as apparent from FIG. 3.

In order to further ensure the vertical alignment of the test tubes in the test tube rack according to FIG. 3, the insert according to the invention is provided with guiding elements 14. These guiding elements 14 are intended to guide the prolongation movement of the lower portion of the insert in a vertical direction in the hole in the tray 4 when a test tube is inserted into the insert and, at the same time, restrict the horizontal movement of the lower portion of the insert in that hole.

In the embodiment of the test tube holder insert according to the invention, shown in FIG. 2, the guiding elements 14 comprise guiding pins projecting from the ring 11 towards the ring 8. These guiding pins extend parallel to the centre axis of the rings 8 and 11 and are adapted to engage, with their outsides, the hole wall of a hole in the tray 4 in the test tube rack shown in FIG. 3 for test tubes of all diameters that could come into question for the insert.

According to a preferred embodiment of the test tube holder insert according to the invention, the spring members 12 are articulately connected to the rings 8 and 11. This is accomplished in that notches 15 are formed in the outside of the spring members 12 at the transition between the spring members and the rings 8 and 11, respectively. Of course, the notches 15 are not necessary but are preferable in certain applications where some kind of a hinge function is required between the rings 8 and 11, and the spring members 12, e.g. to avoid that the pressure from the spring members 12 will be too great on test tubes of larger diameters within the range of diameters in question.

The test tube holder insert according to the invention is made of plastic, e.g. polyetheretherketone, and injection moulded in one piece. The test tube holder inserts according to the invention are manufactured to be able to receive test tubes whose diameters lie within certain intervals such as 5–12 mm, 10–16 mm and 15–24 mm. Due to the design of the spring members, the test tube holder insert according to the invention will be very stable and will guarantee a vertical alignment of the test tubes within the interval of diameters in question in the test tube racks of today.

I claim:

1. A unitary test tube holder insert to be inserted into a hole in a test tube rack for receiving test tubes of different diameters, the insert comprising a first ring to be secured in the hole and being provided with plurality of spring members extending at one end from the first ring towards a centre axis of the ring to resiliently engage the outside of a test tube inserted into the insert, wherein the spring members are connected at their other end to a second ring which is arranged coaxially with the first ring along the centre axis, and fiber wherein each spring member is curved towards the centre axis to exhibit a straight section which extends parallel to the centre axis and which resiliently engages the outside of a test tube inserted into the insert.

2. Insert according to claim 1, wherein the spring members are articulately connected to the first ring and the second ring, respectively.

3. Insert according to claim 1, wherein the second ring is provided with guiding elements which extend parallel to the centre axis towards the first ring and which are adapted to contact a wall of an underlaying hole in a test tube rack.

4. Insert according to claim 2, wherein the second ring is provided with guiding elements which extend parallel to the centre axis towards the first ring and which are adapted to contact a wall of an underlaying hole in a test tube rack.

5. Insert according to claim 1, wherein the second ring is axially moveable in response to the deflection of the spring members.

* * * * *

UNITED STATES PATENT AND TRADEMARK OFFICE

CERTIFICATE OF CORRECTION

PATENT NO. : 5,985,219
DATED : November 16, 1999
INVENTOR(S) : Torsten Lind

It is certified that error appears in the above-identified patent and that said Letters Patent is hereby corrected as shown below:

Claim 1, column 4, line 5, after "with", insert --a--.

Signed and Sealed this

Twenty-third Day of May, 2000

*Attest:*

Q. TODD DICKINSON

*Attesting Officer*

*Director of Patents and Trademarks*